US005611632A

United States Patent [19]

Hiramatsu et al.

[11] Patent Number: 5,611,632

[45] Date of Patent: Mar. 18, 1997

[54] RECORDING APPARATUS HAVING BIASED RECORDING MEANS

[75] Inventors: Soichi Hiramatsu; Tetsuo Suzuki, both of Yokohama, Japan

[73] Assignee: Canon Kabushiki Kaisha, Tokyo, Japan

[21] Appl. No.: 428,798

[22] Filed: Apr. 24, 1995

Related U.S. Application Data

[63] Continuation of Ser. No. 68,608, May 27, 1993, abandoned, which is a continuation of Ser. No. 654,192, Feb. 12, 1991, abandoned.

[30] Foreign Application Priority Data

Feb. 13, 1990 [JP] Japan ..... 2-29717
Feb. 13, 1990 [JP] Japan ..... 2-29718

[51] Int. Cl.[6] ..... B41J 19/20

[52] U.S. Cl. ..... 400/335; 400/323

[58] Field of Search ..... 400/55–57, 59, 400/320, 323, 328, 335, 352, 354

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,609,299 | 9/1986 | Hattori et al. | 400/229 |
| 4,723,129 | 2/1988 | Endo et al. | 346/1.1 |
| 4,740,796 | 4/1988 | Endo et al. | 346/1.1 |
| 5,032,033 | 7/1991 | Stempfl | 400/320 |
| 5,044,797 | 9/1991 | Walker et al. | 400/335 |

FOREIGN PATENT DOCUMENTS

| | | | |
|---|---|---|---|
| 0205941 | 12/1986 | European Pat. Off. . | |
| 2117592 | 7/1972 | France . | |
| 54-56847 | 5/1979 | Japan . | |
| 60-71260 | 4/1985 | Japan . | |
| 248765 | 11/1986 | Japan | 400/352 |
| 284468 | 12/1986 | Japan | 400/55 |
| 62-000937 | 1/1987 | Japan . | |
| 99178 | 5/1987 | Japan | 400/335 |
| 63-21166 | 1/1988 | Japan . | |
| 57272 | 3/1988 | Japan | 400/335 |

OTHER PUBLICATIONS

English translation of Japanese Utility Model Application No. 62–937.

IBM Technical Disclosure Bulletin vol. 28 No. 9, Feb. 1986.

*Primary Examiner*—Stephen R. Funk

*Attorney, Agent, or Firm*—Fitzpatrick, Cella, Harper & Scinto

[57] ABSTRACT

A recording apparatus includes a recorder for recording on a recording medium, with the recorder being capable of moving toward and away from a conveyance route of the recording medium. A drive force transferring device transfers a drive force to the recorder and moves the recorder across the conveyance route of the recording medium. The recorder is biased toward a direction of the conveyance route of the recording medium by the drive force transferring device.

22 Claims, 9 Drawing Sheets

RECORDING APPARATUS HAVING BIASED RECORDING MEANS

This application is a continuation of application Ser. No. 08/068,608 filed May 27, 1993, now abandoned, which is a continuation of application Ser. No. 07/654,192 filed Feb. 12, 1991, abandoned.

BACKGROUND OF THE INVENTION

1. Field of the Invention

This invention relates to a recording apparatus that performs recording on a recording paper.

2. Related Background Art

With the recent development of information processing systems, a variety of recording apparatuses have been developed. Of the recording methods used for these apparatuses, there is a serial-type recording method such that recording is performed in the traveling process of a recording head.

The ink jet recording apparatus using this serial-type recording method is usually constituted as shown in FIG. 12. A carriage 51 having a recording head 50 is movably mounted onto a guide rail 52. At the back of this carriage 51, a timing belt 53 is fixed in parallel to the guide rail 52 so that the drive force of a motor 54 is transferred through the timing belt 53.

In actual recording, the aforementioned motor 54 rotates both forwardly and reversely so that the carriage 51 can be reciprocated in parallel to a platen 55. In association with this movement, ink is discharged selectively from the recording head 50, thereby enabling recording on the recording sheet or paper 56.

With the ink jet recording, it is necessary to constantly maintain the space interval between an orifice surface of the recording head 50 (a discharge port surface) and the recording paper 56. As shown in FIG. 14, according to the conventional constitution used for maintaining the space interval at a constant, the carriage 51 is mounted movable along the axis of the guide rail 52 with its front end 51*a* contacted with a sheet pressing member 58, which is pressing the recording paper 56 against the friction roller 57 with the weight of the carriage 51.

With the carriage front end 51*a* in contact with the sheet pressing member 58, the carriage 51 travels along the guide rail 52, thus allowing a uniform space interval between the orifice surface of the recording head 50 and the recording paper 56 to be maintained.

However, in the above-mentioned constitution, a biasing force for biasing the front end of the carriage 51 against the paper pressing plate 58 is generated only by the weight of both carriage 51 and the recording head 50 mounted thereon. This causes the timing belt 53 to vibrate, for example when the carriage 51 reverses its traveling direction. The carriage 51 is liable to be effected by the vibration. This vibration on the part of the timing belt 53 will cause the carriage 51 to also vibrate as indicated by the arrow B in FIG. 14. This changes the uniform space interval between the orifice surface and the recording paper 56, so that recording may be performed in a waving state.

Furthermore, to raise the recording speed with regard to the reversed motion of the carriage 51, it is necessary to shorten the reversing time. In addition, both the timing belt 53 and the carriage 51 receive stronger impacts, causing recorded images to become more wavy.

In the recording apparatus, the transport roller 57 is not a single roller, but the transport roller 57 consists of a number of axially separated rollers mounted on the roller axis as illustrated in FIG. 12. This is for cost reduction by reducing the amount of rubber material constituting the transport roller 57 as well as for reducing of the weight of the apparatus.

As illustrated in FIG. 15, when the contact portion 51*a* of the carriage is pressed between adjacent transport rollers 57, the sheet pressing member 58 is slightly flexed inwardly toward the transport rollers 57. With the carriage 51 moving while it is in contact with the flexed sheet pressing member 58, the carriage 51 traces the curved profile of the sheet pressing member 58 and rocks around the guide rail 52 in the direction indicated by arrow B in FIG. 14.

Thus, the space interval between the carriage 51 and the recording paper 56 is not constant, causing recorded images to be wavy.

SUMMARY OF THE INVENTION

An object of this invention is to provide a recording apparatus which can perform recording with high quality.

An object of this invention is to provide a recording apparatus which can perform recording with high speed without any deterioration in recording quality.

An object of this invention is to provide a recording apparatus that can perform recording with a fine image by maintaining a constant space interval between the recording paper and the recording means.

An object of this invention is to provide a recording apparatus in which, even if there occurs vibration in transfer means when the carriage is reversed, it is possible to dump the vibration against the carriage since the carriage is always biased by transfer means in a predetermined direction.

An object of this invention is to provide a recording apparatus which can perform recording with a fine image by preventing the sheet pressing member from being flexed inwardly.

A further object of the invention is to provide a recording apparatus in which a pressing force by the contact portion to the sheet pressing member effects a portion supported by a conveying rotary member since the length between the conveying rotary members is substantially equal to the length of the contact portion so that the sheet pressing member does not suffer from being flexed inwardly due to pressing by the contact portion of the carriage, thus preventing rocking movement of the carriage when it reciprocally moves during recording so as to record a fine and clear image.

DETAILED DESCRIPTION OF THE PREFERRED EMBODIMENT

Described hereinbelow is an example of the aforementioned means in the case where the present invention was applied to the serial-type ink jet recording method which uses thermal energy for ink discharge.

Figure 1:
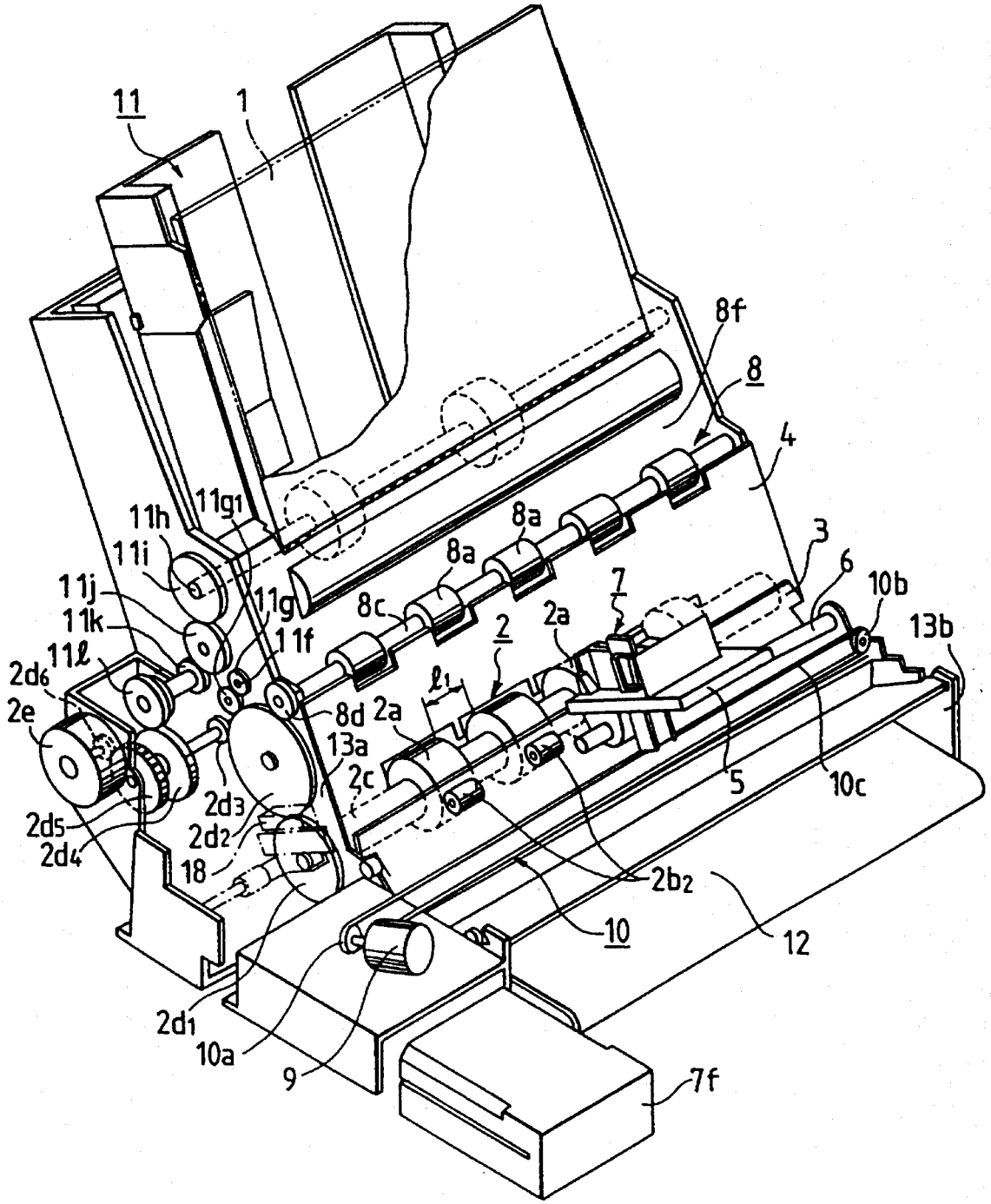
FIG. 1 is a perspective view illustrating the serial-type ink jet recording apparatus with reference to one embodiment of the present invention.
Figure 2:
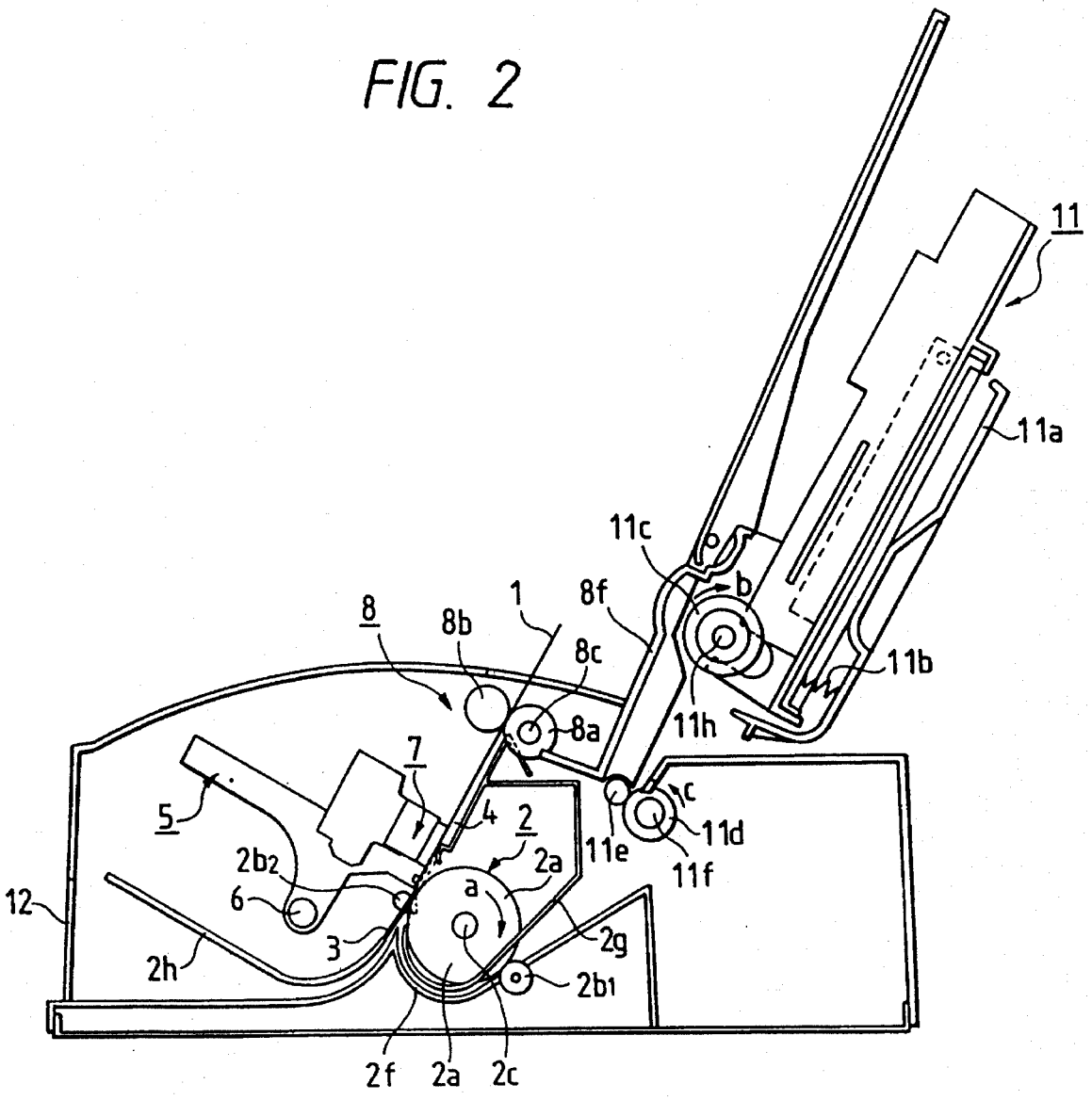
FIG. 2 is a cross sectional view illustrating the serial-type ink jet recording apparatus.

FIG. 1 is a perspective view showing the entire recording apparatus. FIG. 2 is a cross sectional view of the apparatus.

ENTIRE STRUCTURE

First of all, the entire structure of the apparatus is explained. A recording sheet or paper 1 as a recording medium is transported by the sheet or paper transport means 2. This recording paper 1 is pressed by the sheet pressing member 3 against a plurality of transport rollers 2*a*, which are axially spaced at an interval and serves as a conveying rotary member. Thus the recording paper does not float from the platen 4. The sheet pressing member 3 comprises a flat elastic plate and is pressed against the transport rollers 2*a*.

As the recording paper 1 is conveyed, the carriage 5 is reciprocally moved along the guide rail 6 while the recording means 7 is driven to record an image on the recording paper 1. After recording, the recording paper 1 is exhausted through the exhausting means 8.

The carriage 5 is driven by a driving force of the carriage motor 9 via the transferring means 10, thus allowing the carriage to reciprocally move, crossing the feeding direction of the recording paper 1. The carriage 5 is rotatably attached around the guide rail 6. As will be explained in detail later, the carriage 5 is always biased by the timing belt 10*c* constituting the transfer means 10 to contact the sheet pressing member 3.

The carriage 5 has a contact portion 5*a* at a front end thereof, which is in contact with the sheet pressing member 3. Accordingly, the accuracy in the space interval between the ink discharge port (to be explained later) and the recording paper is improved. In addition, the length of the contact portion 5*a* is disposed so as to be substantially equal to the space interval between transport rollers 2*a*.

Parts comprising the aforementioned recording apparatus will be hereinafter described in detail.

Paper Transport Means

The paper transport means 2 transports the recording paper 1 to the positions where recording means 7 perform recording. In the present embodiment, the paper transport means 2 feeds either a recording paper supplied through the ASF (Automatic Sheet Feeder) 11 which is removable to the apparatus, or a recording paper supplied through the manual supply port 12.

The paper transport means 2 in the present embodiment transports the recording paper 1 by the transport roller 2*a* which rotates forwardly in the direction indicated by the arrow a in FIG. 2 and front pinch roller $2b_1$ and back pinch roller $2b_2$ which rotates accordingly.

The transport rollers 2*a* are arranged as a plurality of separate rollers and are mounted on the roller rod 2*c* which is rotatably supported by both the left and right walls 13*a* and 13*b*. Those transport rollers 2*a* are arranged with an interval $l_1$ of 25 to 55 mm between two adjacent rollers 2*a*. As compared with a continuous roller provided along the entire width of the sheet conveyance route, when the transport rollers are divided it is possible to cut costs by reducing the amount of rubber and also as reduce the weight of the apparatus.

As illustrated in FIG. 1, a transport gear $2d_1$, coupled to the roller axis 2*c* engages with an idler gear $2d_2$, which is meshed with a first transmission gear $2d_3$. The axis of the first gear $2d_3$ is coupled to a second gear $2d_4$ and a third gear $2d_5$, all of which rotate in unison. The third gear $2d_5$ engages with a motor gear $2d_6$ which is coupled to a transport motor 2*e*.

As transport motor 2*e* rotates, its drive or rotational force is transferred to the roller axis 2*c* via the above-mentioned gear train, thereby allowing the transport roller 2*a* to rotate.

Pinch rollers $2b_1$ and $2b_2$ are in contact under pressure with the surface of the transport roller 2*a* by springs which are not shown, and disposed so as to rotate with the rotation of the transport roller 2*a*. Accordingly, the transport roller 2*a* and pinch rollers $2b_1$ and $2b_2$ nip the recording paper 1 and feed it.

Furthermore, as illustrated in FIG. 2, a paper pan 2*f* is attached below the above-mentioned transport roller 2*a*. The pan 2*f* is curved along the periphery of the roller 2*a*. This paper pan 2*f* extends up to the manual supply port 12, serving as a lower guide for the recording paper 1 which is supplied manually.

Above the paper pan 2*f*, upper guide plates 2*g* and 2*h* are also provided at the predetermined spacing to form a conveyance route for the recording paper 1.

In the constitution above mentioned, when the transport motor 2*e* is driven to rotate the transport roller 2*a* in the direction indicated by the arrow a in FIG. 2, the recording paper supplied through the ASF 11 is nipped and transported by the front pinch roller $2b_1$ and the transport roller 2*a*. Then the recording paper is guided around the periphery of the transport roller 2*a* and is nipped by the rear pinch roller $2b_2$ and the transport roller 2*a* for feeding it to a recording position located above.

On the other hand, the recording paper supplied through the manual supply port 12 is nipped by the transport roller 2*a* and the rear pinch roller $2b_2$ and transported to the recording position.

A brief explanation is herein given with regard to the ASF 11 which performs automatic supply of the recording paper 1 to the transport means 2.

The ASF 11 is removably mounted on the recording apparatus. As illustrated in FIG. 2, the uppermost one of the recording papers 1 contained in the cassette 11*a* is pressed against a separate roller 11*c* through the press spring 11*b*. As the separate roller 11*c* rotates in the direction indicated by arrow b in FIG. 2, the uppermost sheet is separated and fed to a nip portion between a regist roller 11*d* and the upper roller 11*e* in contact under pressure therewith. As the regist roller 11*d* rotates toward the direction indicated by arrow c in FIG. 2, the recording paper 1 is nipped by the regist roller 11*d* and the upper roller 11*e* which rotates following the rotation of the regist roller 11*d*, and conveyed to the paper transport means 2.

The mechanism that transfers the drive force to the regist roller 11*d* is arranged such that, as illustrated in FIG. 1, a regist gear 11*g* is attached to the roller axis 11*f* which is fixed to the regist roller 11*d*. The regist gear 11*g* engages with the idler gear $2d_2$ via the idler gear $11g_1$.

As for the mechanism that transfers the drive force to the separate roller 11*c*, a separate gear 11*i* is attached to the roller axis 11*h* on which the separate roller 11*c* is attached. The separate gear 11*i* engages with the idler gears 11*j* and 11*k*. A gear 11*l* which is attached on the same axis as the gear 11*k* engages with the secondary gear $2d_4$.

Accordingly, as the transport motor 2*e* is driven, the drive force is transferred via the above-mentioned gear train, thus allowing the separate roller 11*c* and the regist roller 11*d* to rotate.

The Paper Pressing Member

The paper pressing member 3 presses the recording paper 1 sent by the transport means 2 against the transport roller 2*a*, thus preventing the recording paper 1 from floating from the platen 4.

As illustrated in FIG. 1, this paper pressing member 3 comprises a plate member having a width which is wider than the traveling span of the carriage 5 and it is in contact under pressure with each transport roller 2*a* by a spring etc. (not shown).

The leading edge of the paper pressing member 3 is positioned upstream of the recording position of the recording means 7 (with regard to the paper feeding direction). The transported recording paper 1 is pressed against the transport roller 2*a* by the paper pressing member 3, thus preventing the recording paper 1 at the recording position from floating off the platen 4.

In addition, the paper pressing member 3 is arranged such that it always contacts the front end of the carriage 5. This allows the distance accuracy between the recording paper 1 and the ink discharge port to always be maintained.

Carriage

The carriage 5 reciprocally moves the recording means 7 along the width direction of the recording paper 1.

The carriage 5 is slidably attached to the guide rail 6 which has a round section and is supported by the left and right walls 13*a* and 13*b* at both ends thereof.

Figure 3:
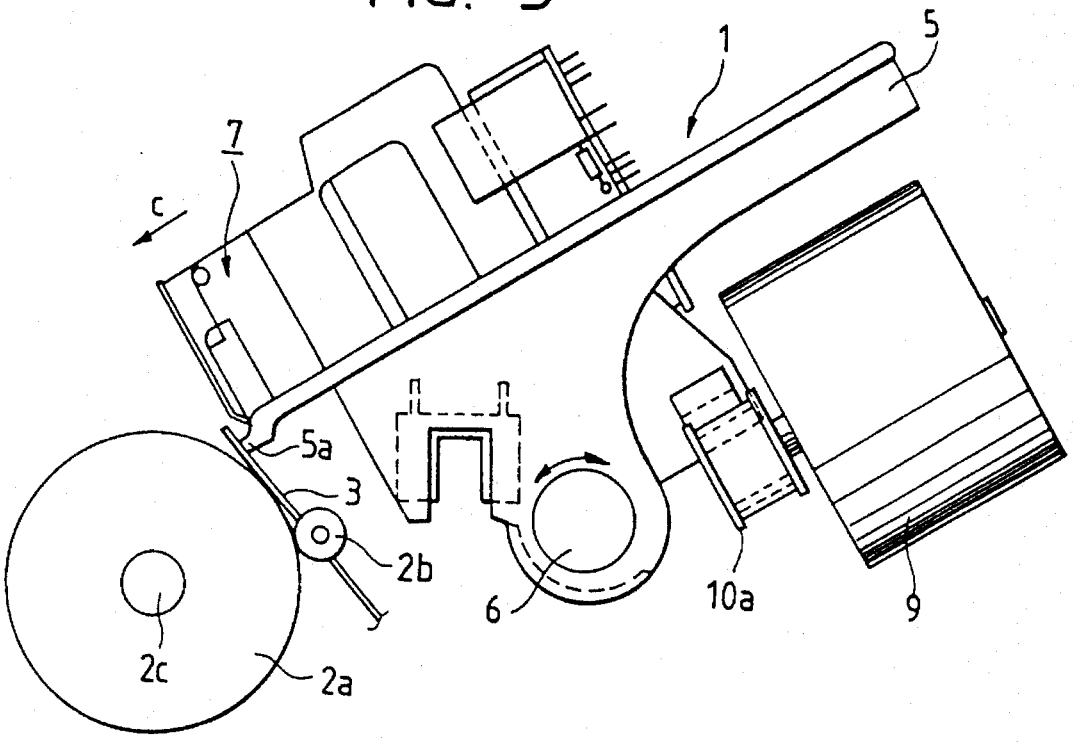
FIG. 3 is an enlarged cross sectional view showing how the carriage is biased against the sheet pressing member.

Further, the carriage 5 is rotatably attached to the guide rail 6 as an axis thereof in such a manner that its front end inclines downward facing the recording paper 1 as shown in FIG. 3. As a result, the front end of the carriage 5 is applied with a force toward the direction indicated by the arrow c in FIG. 3 by the weight of both the carriage 5 and the recording means which is mounted on the carriage 1. By the biasing force the front end of the carriage 5 can be in contact with the paper pressing member 3. The timing belt 10*e* also pushes the carriage 5 toward the same direction indicated by the arrow c.

Figure 4:
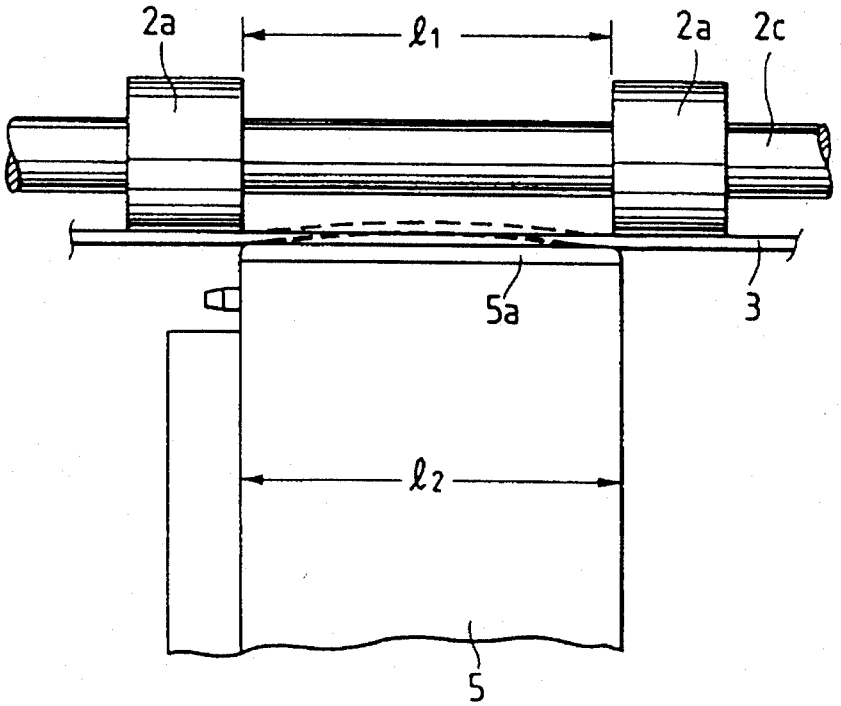
FIG. 4 is a view illustrating the space interval between the transport rollers in relation to the length of a carriage.

At the front end of the carriage 5, there is provided a contact portion 5*a* that serves as a guide for determining the space interval between the recording paper and the ink discharge port. This contact portion 5*a* has a length exceeding $l_2$ as illustrated in FIG. 4. The length $l_2$ is equal to or slightly longer than the distance $l_1$ between transport rollers 2*a* in the transport means 2.

At the time of recording, the contact portion 5*a* travels while pressing the paper pressing member 3. At that time, the paper pressing member 3 is applied with a force that would normally bend the member 3 between adjacent transport rollers 2*a* as shown by dashed lines in FIG. 4. This is because there is no member for supporting the paper pressing member 3 between the adjacent transport rollers 2*a*. With the present embodiment, however, the pressure applied by the contact portion 5*a* on the paper pressing member 3 falls on a portion supported by transport rollers 2*a*, because the length $l_2$ of the contact portion 5*a* is equal to, or longer than the distance $l_1$ between the transport rollers 2*a*. Consequently, the paper pressing member 3 is now free of curving even when it is pressed by the contact portion 5*a*. Accordingly, when the carriage 5 reciprocally moves during recording, no rocking motion occurs in direction indicated by the arrow c in FIG. 3, so that a space interval between the recording means 7, which is mounted on the carriage 5, and the recording paper 1 is to be always maintained constant without image blur. There is an additional advantage of setting the length of the contact portion 5*a* as mentioned above in that it receives less abrasion and its durability improves.

Based on the reasons described above, it is desirable that the length $l_2$ of the contact portion 5*a* is equal to, or longer than the length $l_1$ between transport rollers 2*a*. Even if the length $l_2$ is slightly less than $l_1$, the result will come out almost the same. With the present embodiment, the length $l_2$ of the contact portion 5*a* is established at from 40 mm to 55 mm.

Transferring Means

The transferring means 10 transfers the drive force of the carriage motor 9 to the carriage 5, thereby enabling the carriage 5 to reciprocate.

As illustrated in the mechanism in FIG. 1, a driving pulley 10*a* is attached at one end of the traveling range of the carriage 5, and a follower pulley 10*b* at the other end. Coupled to the driving pulley 10*a* is a carriage motor 9. An endless-type timing belt 10*c* is mounted in parallel to the guide rail 6 between the pulleys 10*a* and 10*b*. A part of the timing belt 10*c* is fixed or coupled to the carriage 5.

As the carriage motor 9 rotates forwardly or reversely, the driving force of the motor 9 is transmitted to the carriage 5 through the timing belt 10*c* so that the carriage 5 can be reciprocated along the guide rail 6.

With the present embodiment, the timing belt 10*c* is coupled to the carriage 5 in such a manner that the carriage 5 is motivated toward the direction indicated by the arrow c in FIG. 3. The arrangement will be hereinbelow described in more detail.

Figure 5:
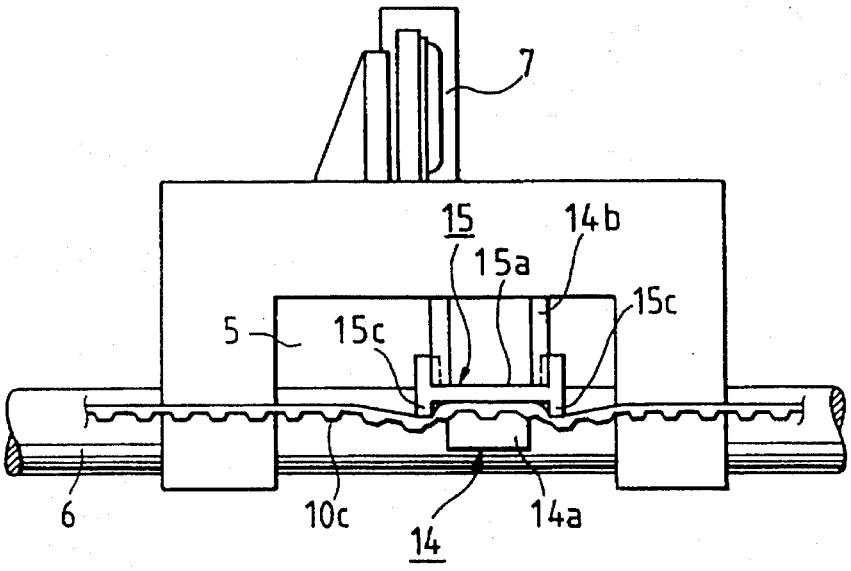
FIG. 5 is a view illustrating how the timing belt is coupled to a carriage.
Figure 6A:
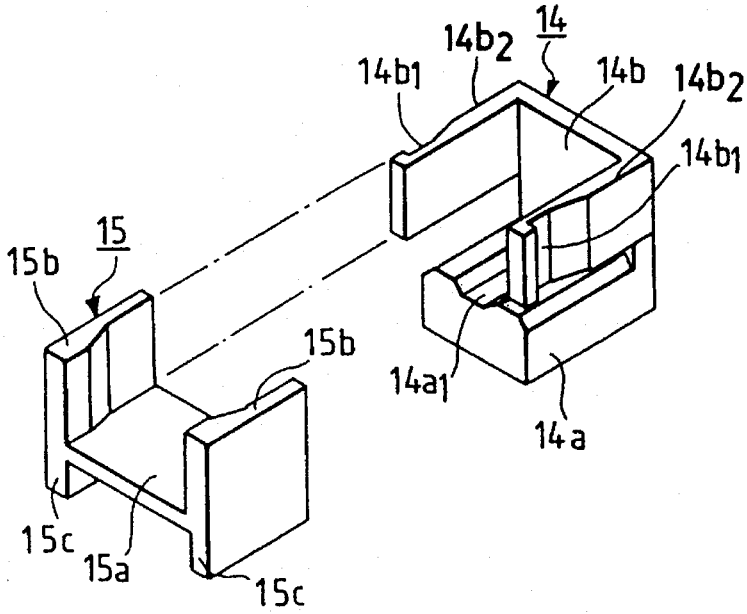
FIGS. 6A and 6B are views illustrating a belt sustainer and a fixing member.
Figure 6B:
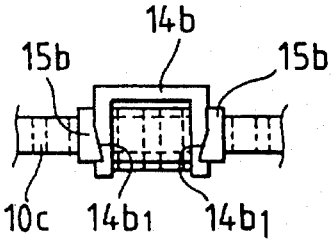

FIG. 5 is a view illustrating a portion at which the timing belt 10*c* is coupled to the carriage 5 as seen from the back facing the recording surface. FIGS. 6A and 6B show a fixing member for coupling the belt 10*c* to the carriage 5, as well as the fixed state.

At the back of the carriage 5, a belt sustainer 14 is set to connect the belt 10*c* to the carriage 5. This belt sustainer 14 is arranged at the same level with respect to the timing belt 10*c* when the belt 10*c* is extended between the pulleys 10*a* and 10*b*.

As shown in FIG. 6A, the belt sustainer 14 has a lower part 14*a* and an upper part 14*b* at a predetermined interval. The lower part 14*a* has a tooth portion $14a_1$ on its surface for engaging with the teeth of the timing belt 10*c* to fix each other. On the other hand, the upper part 14*b* is U-shaped in cross-section and has cuts $14b_1$ on both flexible fingers $14b_2$ where a fixing member 15 fits in and locks. (Refer to FIG. 6B).

As sketched in FIG. 6A, the fixing member 15 is H-shaped in a longitudinal section and has locking parts 15*b* above both ends of the crosspiece 15*a* so that the locking parts 15*b* fit into the cuts $14b_1$ of the flexible fungus $14b_2$ of the upper part 14*b*. Furthermore, protrusions 15*c* are provided at both ends below the crosspiece 15*a* in order to give curvature to the timing belt 10*c*.

The gap between the lower part 14*a* and upper part 14*b* of the belt sustainer 14 is arranged so as to be slightly wider than the combined thickness of both the timing belt 10*c* and the crosspiece 15*a*. Accordingly, as illustrated in FIG. 5, the timing belt 10*c* is fastened to the belt sustainer 14 by matching the teeth of the timing belt 10*c* with that of the tooth part 14*a*$_1$, and by inserting the crosspiece 15*a* of the fixing member 15 into between the upper part 14*b* and the lower part 14*a*. At this time, the locking parts 15*b* lock into the notches 14*b*$_1$ of the upper part 14*b* and the fixing part 15 is firmly locked to and prevented from being removed from the belt sustainer 14.

When the timing belt 10*c* is coupled to the belt sustainer 14 by means of the fixing part 15, as shown in FIG. 5, the timing belt 10*c* is pressed downward in FIG. 5 or to the direction away from the recording paper 1 by the protrusions 15*c* of the fixing part 15 below the horizontal level of the timing belt extended between the pulleys 10*a* and 10*b*. Thus the belt 10*c* is arcuate.

Where the timing belt 10*c* is curved as described above, the carriage 5 receives an upward biasing force toward the upper direction of FIG. 5 or to the direction up to the conveyance route of the recording sheet by the tensioning force of the timing belt 10*c*. Accordingly, the carriage 5 is applied with the biasing force for rotating in the direction as shown by arrow c in FIG. 3 thereby allowing the contact portion 5*a* to be pressed against the paper pressing member 3 by weight and the biasing force.

Accordingly, the contact portion 5*a* can always maintain its firm contact with the paper pressing member 3 even when vibration occurs with the timing belt 10*c* when the carriage 5 rotates in the reversal direction. Thus a space interval can be always maintained between the recording means 7 mounted on the carriage 5 and the recording paper 1.

Recording Means

The recording means is mounted on the carriage 5 as described previously and records ink images on a recording paper conveyed by transport means 2. An ink jet recording method is used as the most suitable for the recording means of this apparatus.

In the ink jet recording method there is provided a liquid discharge port for emitting a flying liquid droplet and a liquid flow path communicating with the discharge port and energy generating means provided at one portion of the liquid flow path for jetting the ink liquid contained inside the path. The energy generating means is activated in response to image signals and emits an ink droplet for recording images.

There are such discharge energy generating means as: a pressure energy generating means using electromechanical converting devices such as piezo elements, an electromagnetic energy generating means using electromagnetic waves such as a laser, for example, which are radiated upon the ink liquid and absorbed therein for producing droplets, or a thermal energy generating means using electro-thermal converting devices. Of these energy generating means, the thermal energy generating means is a most suitable means in that it allows the discharge ports to be laid out with high density and also a recording head to be reduced in size.

The recording means in the present embodiment of this invention utilizes an ink jet recording method using thermal energy for ink discharge which is one of the above-mentioned ink jet recording methods.

Figure 7:
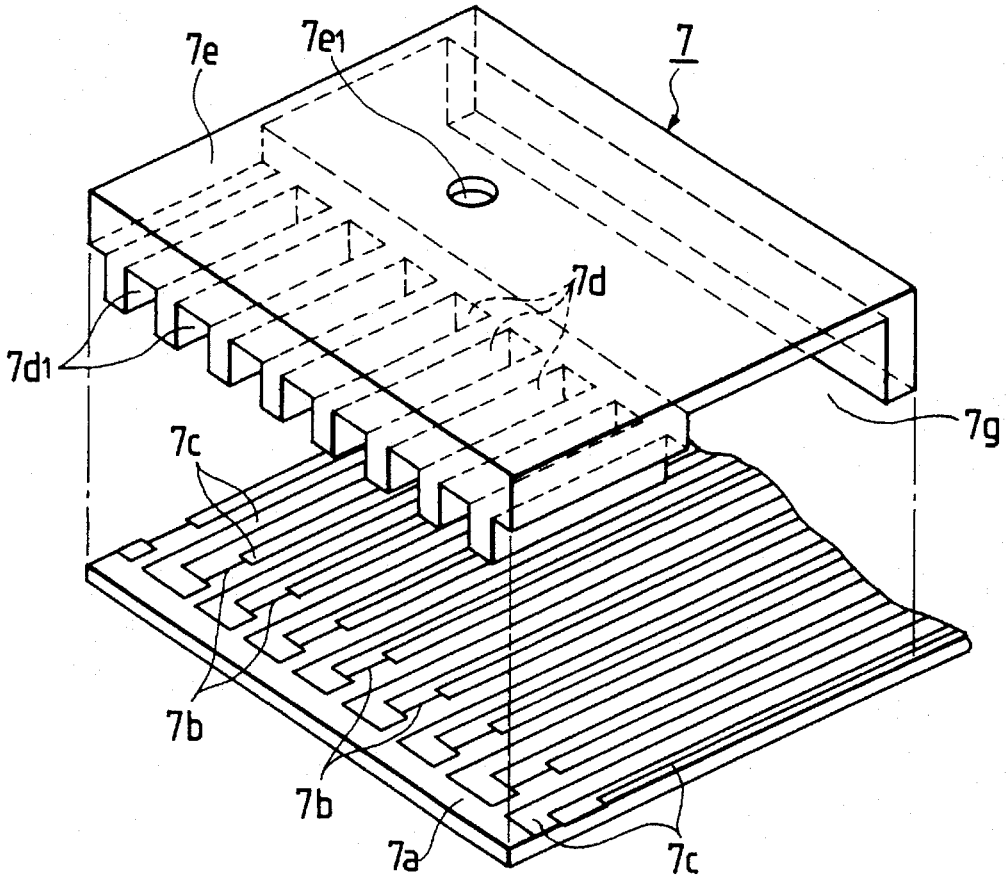
FIG. 7 is a view showing the constitution of a recording head.

FIG. 7 is a view showing the arrangement of a recording head 7, which comprises the recording means. FIGS. 8A to 8G show an illustration of the ink jet recording principle using thermal energy for ink discharge.

As illustrated in FIG. 7, 7*a* is a heater board. 7*b* are electro-thermal converting elements (discharge heaters) on a silicone substrate. 7*c* are aluminum electrodes that supply power to the elements and that is formed as film. The heater board 7*a* is affixed to a top plate 7*e*, which have partition walls for each recording liquid flow path (a nozzle) 7*d*. Furthermore, as illustrated in FIG. 1, an ink cartridge 7*f* is demountably attached to the left of this apparatus for the ink supply to the said recording head 7.

The ink supplied by the ink cartridge through a conduit (not shown) flows through an intake port 7*e*$_1$ on the top plate 7*e*, and fills a common liquid chamber 7*g* in the recording head 7. The ink is then guided to each nozzle 7*d* from this common liquid chamber 7*g*. These nozzles 7*d* provided with ink discharge ports 7*d*$_1$, which are disposed so as to face the recording paper 1 of the recording head 7, and placed vertically across the paper feeding direction (the vertical direction on the FIG. 1) at the predetermined pitch.

The principle of ink jetting used for the above-described ink jet recording method is herein explained with reference to FIGS. 8A and 8B.

Figure 8A:
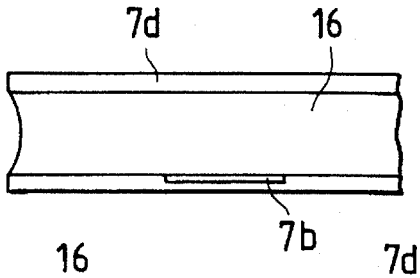
FIGS. 8A to 8G show a principle for ink jet recording.
Figure 8B:
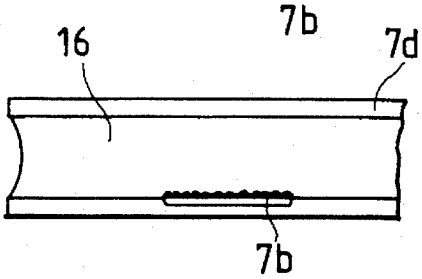
Figure 8C:
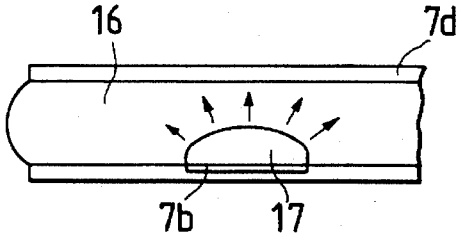

As illustrated in FIG. 8A, under normal circumstances the ink 16 stays inside the nozzle 7*d* because the external pressure is balanced with the surface tension of the ink at the discharge ports. In order to fly the ink 16, electro-thermal converting elements 7*b* inside the nozzle 7*d* must be supplied electricity to produce a sharp increase of the ink temperature beyond the level of nucleus boiling. Then the ink surrounding the electro-thermal converting elements 7*b* is heated to such an extent that a tiny air bubble generates as illustrated in FIG. 8B. Where the ink touches directly with the electro-thermal converting elements, it evaporates and causes film boiling, thus inducing a rapid growth of an air bubble 17 as shown in FIG. 8C.

Figure 8D:
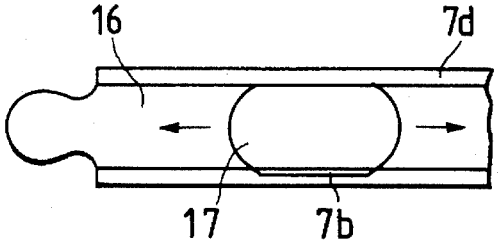
Figure 8E:
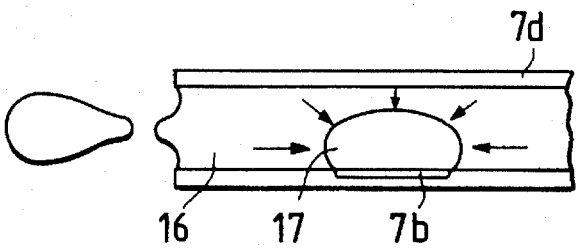
Figure 8F:
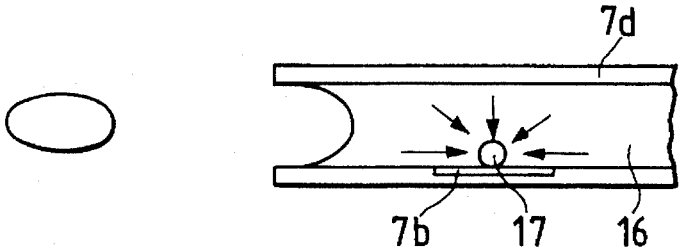
Figure 8G:
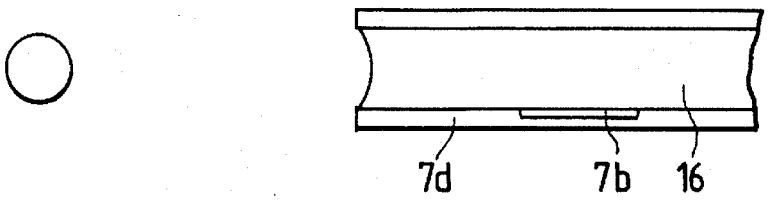

When the air bubble 17 grows to its maximum size as illustrated in FIG. 8D, an ink droplet is pushed out of the discharge ports of the nozzle 7*d*. As the supply of electricity to the electro-thermal converting elements 7*b* is terminated, as shown in FIG. 8E the expanded air bubble 17 is cooled by the ink 16 inside the nozzle 7*d*, and shrinks. This process of growth and shrinkage of an air bubble enables the ink liquid to fly out of the discharge ports. In addition, as shown in FIG. 8F, as the electro-thermal converting elements 7*b* cool down the ink in contact with the surface of the elements gets cooled quickly and the air bubble 17 either disappears or shrinks to a volume that is almost negligible. As the air bubble 17 shrinks, as illustrated in FIG. 8G the ink is supplied to the nozzle 7*d* from the common liquid chamber 7*g* by a capillary action. Thus the nozzle 7*d* is refilled with ink, ready for the next energization.

Accordingly, the supply of electricity to electro-thermal converting elements 7*b* is energized in response to an image signal in synchronism with the movement of the carriage 5.

Further, a capping means 18 is provided at the left end position of the movement of the said carriage 5 as illustrated in FIG. 1. This capping means 18 covers the ink discharge ports of the recording head 7 when recording is not performed, so that the drying or congelation of the ink around the discharge ports of the recording head 7 will be prevented.

Also connected to the said capping means 18 is a pump, which is not shown. The pump is driven to prevent discharge error or remove ink for sucking the ink from the ink discharge ports in order to recover the discharge ports from clogging.

Exhausting Means

The recording paper 1 which is recorded using the recordings means 7, is exhausted by this exhausting means 8.

As illustrated in FIGS. 1 and 2, the exhaust means 8 consist of: exhausting rollers 8*a* and spurs 8*b* that contact these exhausting rollers 8*a*. An exhausting gear 8*d* is attached at both ends of a roller axis 8*c* of exhausting roller 8*a*. The exhausting gear 8*d* engages with an idler gear 2*d*$_2$.

The rotation of the transport motor 2e is transferred to the exhausting rollers 8a and rotates the exhausting rollers 8a, thereby permitting the recording paper 1 to be exhausted with cooperation by the exhausting rollers 8a and the spurs 8b. The exhausted recording paper 1 is stacked at an exhausting stacker 8f, which is positioned above the exhausting rollers 8a.

As described in the recording apparatus of the present embodiment, recording is done with the carriage 5 reciprocating on the recording paper 1. Since the carriage 5 is biased toward the paper pressing member 3 by the timing belt 10c, the contact portion 5a is pressed against the paper pressing member 3 all the time. This allows the space interval between the ink discharge ports of the recording head 7 and the recording paper 1 to be kept constant.

Furthermore, the length of the contact portion 5a is arranged such that it is equal to, or longer than the space between the transport rollers 2a. This prevents the paper pressing member 3 from being curved between the transport rollers 2a, because the pressure onto the paper pressing member 3 from the contact portion 5a can be supported at the transport rollers 2a.

The carriage 5 which moves in contact with the sheet guide member 3 provided in parallel to the platen in parallelism with the recording paper 1 supported by the platen 4, so that a gap between the discharge port surface of the recording head 7 and the recording paper 1 is kept constant.

Accordingly, the recorded images by ink discharged from the recording head 7 are not wavey, thus obtaining images of high quality.

OTHER EMBODIMENTS

Other examples using the constitution of this invention will be explained as follows:

Paper Feeding Means

In the foregoing embodiment described, transport rollers 2a and pinch rollers $2b_1$ and $2b_2$ are used to feed the recording paper 1. It does not necessarily mean that the paper feeding means 2 should always be roller-shaped members. It is conceivable that we use an endless belt that is rotatably constituted for feeding the recording paper 1.

Instead of using the mechanism described in the foregoing embodiment where the recording paper is nipped for feeding by the transport rollers 2a and the pinch rollers $2b_1$ and $2b_2$, it is feasible to set the paper pressing plate 3 so as to press against the transport rollers 2a. In this case, the recording paper 1 is transported with cooperation of both the paper pressing plate 3 and the transport rollers 2a.

Recording Means

Though the ink is supplied to the recording head from the ink cartridge 7f attached to the recording apparatus in the recording means. However, a removable head may also be used, which has an ink storing chamber therein and is disposable when ink in the ink storing chamber is consumed.

Further, this invention is not necessarily limited to the use for the ink jet recording method. The principle can be applied to a variety of recording methods: a thermal transfer recording method such that an ink sheet coated with the heat-melting ink is heated in response to image signals with the subsequent transference of the melted ink to the recording paper 1, a thermal recording method using a thermal-sensitive recording paper 1, which is heated and records images in response to image signals, a wire-dot recording method using a wire that strikes an ink ribbon in response to image signals, etc. Accordingly, the mechanism of the recording head in the present embodiment is not limited to the use for the above-mentioned bubble jet head. Other applications can be thought such as a thermal head, a wire-dot head, a daisy-wheel head, etc.

Coupling a timing belt

Figure 9:
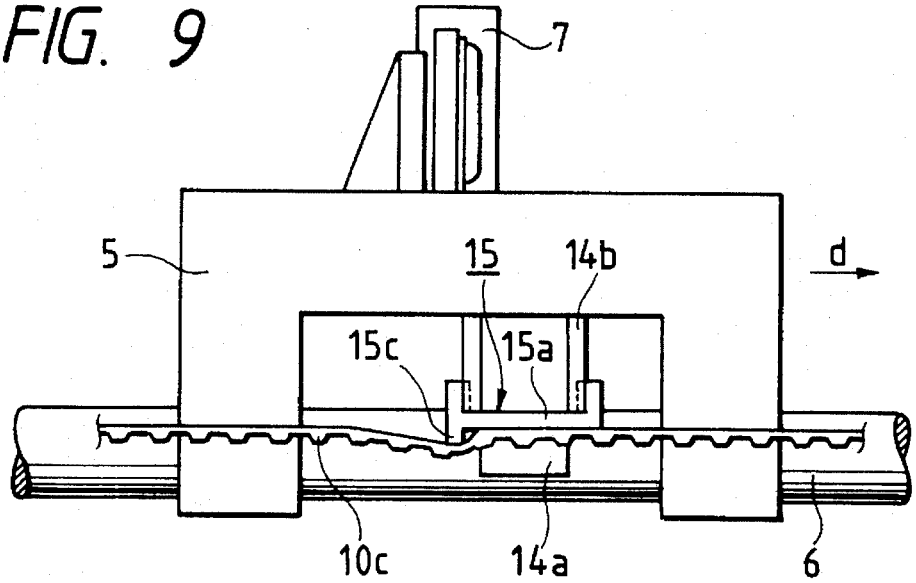
FIGS. 9 and 10 show another embodiment for fixing the timing belt.

FIG. 9 shows another example with regard to coupling the timing belt 10c to the carriage 5. Members which have the same functions as in the first embodiment are illustrated in the same reference numerals.

FIG. 9 is a view illustrating the belt fixing portion from the back of the apparatus. A protrusion 15c of the fixing member 15 is provided only at the left side of the crosspiece 15a, so that the belt 10c is curved in the middle of the moving direction carriage 5.

Generally speaking, in the case of a serial-type recording apparatus (which performs recording with a carriage 5 traveling toward the direction indicated by the arrow d in FIG. 9), the position where the timing belt 10c is coupled to the carriage 5 tends to shift to the right of the recording direction, past the middle point of the carriage. This is due to the structural restriction such as motor positioning etc. As the carriage 5 travels to the left and right for recording in this case, the movement is smooth or stable in the traveling direction toward the right in FIG. 9 (the direction indicated by the arrow d). Traveling toward the left, however, tends to produce unsmooth movements since the point where the timing belt 10c is coupled to the carriage 5 is off the central gravity point of the carriage 5, inducing shaky motions on the part of the carriage 5.

With the present embodiment as illustrated in FIG. 9, a protrusion 15c provided only at the left of the crosspiece 15a pushes the timing belt 10c such that the timing belt 10c is curved at about the middle of the carriage, thereby allowing the transference point of the driving force to be approximately centered inside the carriage 5. This feature obtained through the use of a single protrusion 10c makes the movement of the carriage 5 smooth and stable in both left and right directions.

As described previously with regard to the carriage 5 (which is pressed against the paper pressing member 3), the carriage 5 in the case of the present embodiment is also biased against the paper pressing member 3, thus allowing the space interval between the recording means 7 and the recording paper 1 to be maintained constant all the time.

Accordingly, as arranged above, it becomes possible to perform recording with high-quality for both recording directions.

The coupling position of the timing belt 10c does not necessarily need to be centered inside the carriage 5.

In the present embodiment illustrated in FIG. 9, the timing belt 10c is curved downward about 1.5 mm by the protrusion 15c, wherein pulleys 10a, 10b of a diameter of 10 mm and a timing belt 10c of a total length of 700 mm are used. The dimensions leads to satisfied results.

Figure 10:
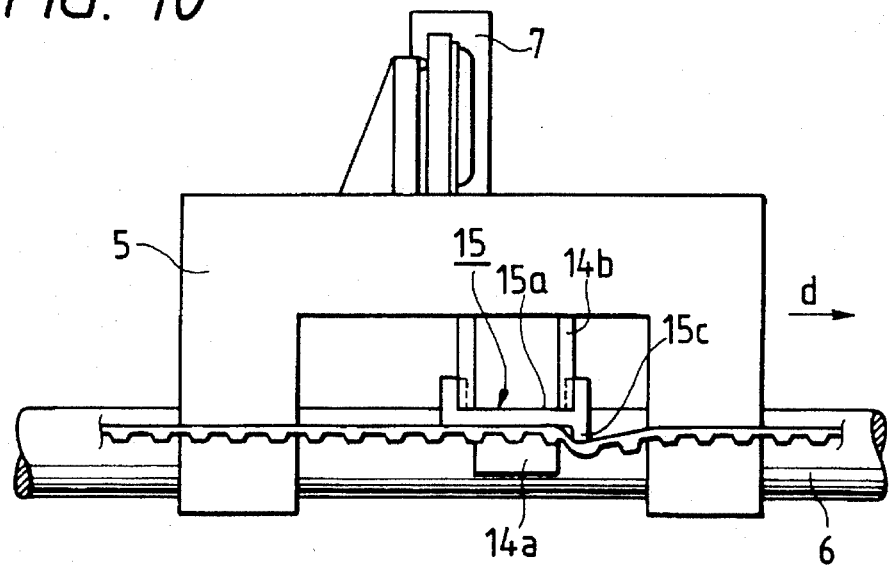

As shown as an example in FIG. 10, a protrusion 15c can also be provided at the right of the crosspiece 15a. In this case, there is constituted a stable movement in the direction toward the right (the direction indicated by the arrow d) because the transference point of the drive force from the timing belt 10c shifts to the right inside the carriage 5. Therefore, this way of coupling the timing belt 10c as illustrated in FIG. 10 constitutes an ideal coupling method for the apparatus where one-way recording is done, assuring a smooth movement of the carriage 5 and recording images of high quality.

Though the drive force is transferred to the carriage 5 via the timing belt 10c in the present embodiment, other transferring means, of course, can be used; a wire for example.

Carriage Contact

In the present embodiment, the contact portion 5a is constituted in the manner such that it forms one continuous line, and its length $l_2$ is equal to the space interval between the two adjacent transport rollers 2a. The contact portion 5a, however, does not necessarily need to have a continuous structure.

Figure 11:
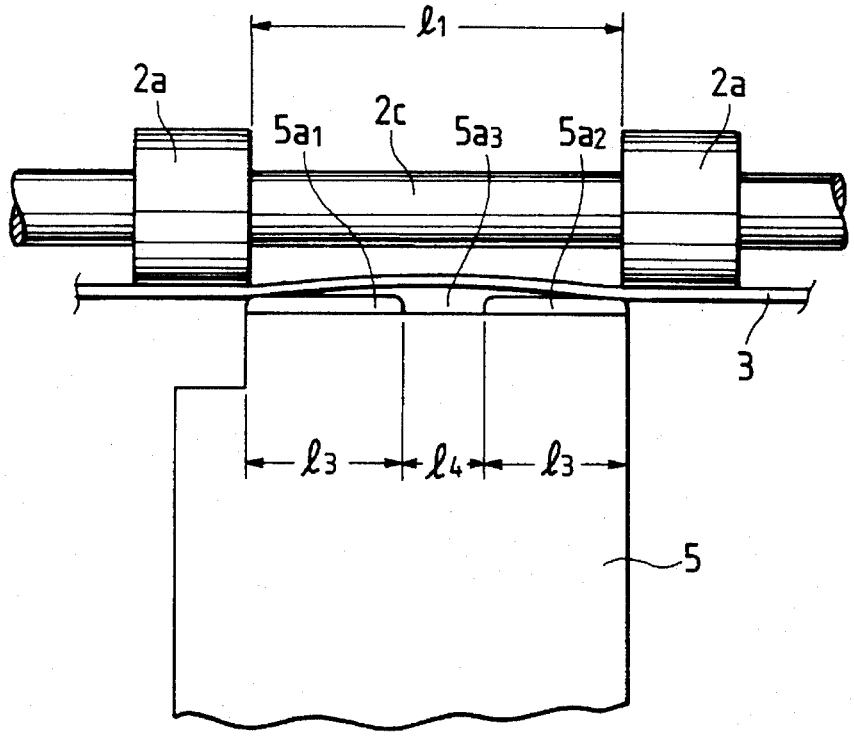
FIG. 11 is a view showing the space interval between transport rollers in relation to the length of the contact portion of the carriage which has a cutout.
Figure 12:
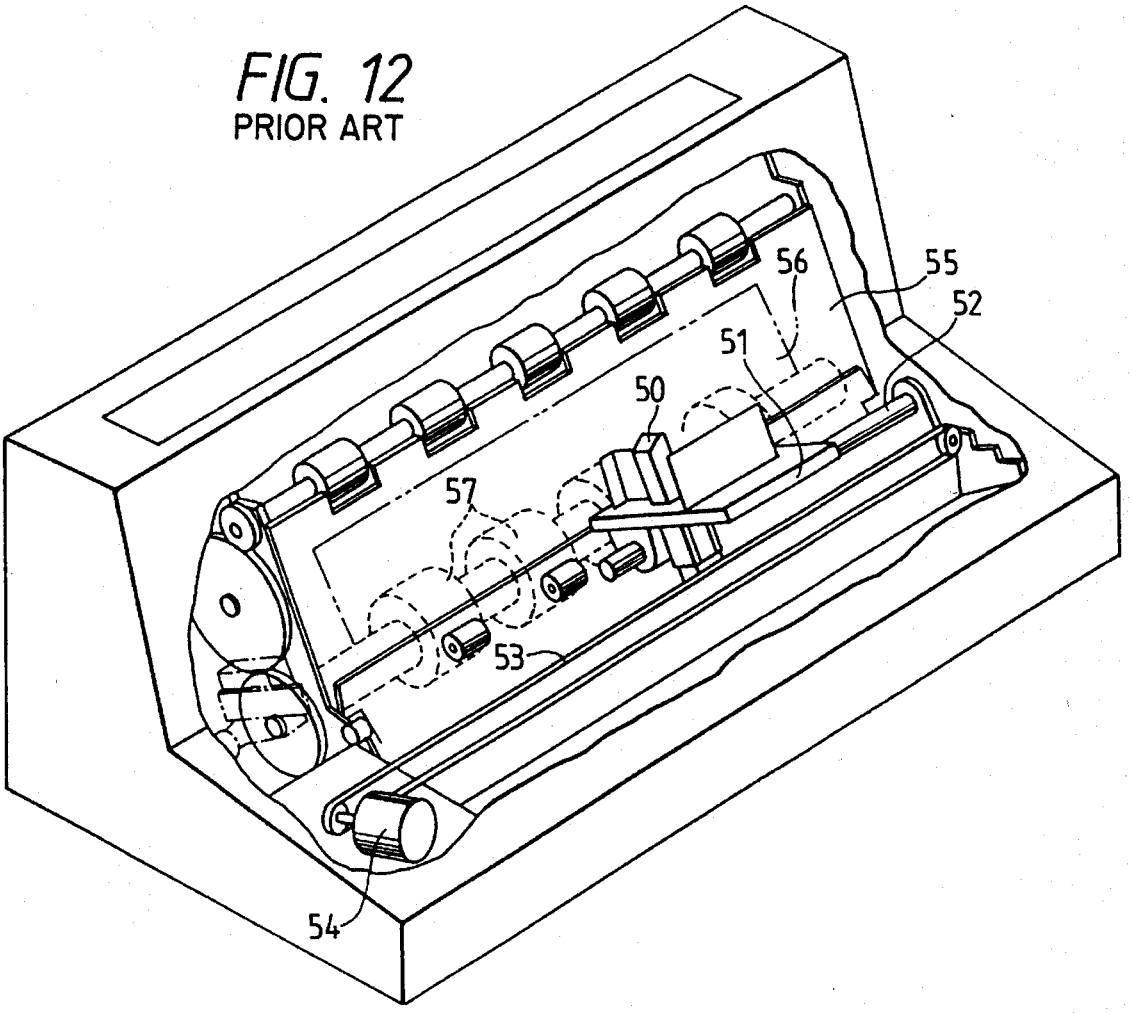
FIG. 12 PRIOR ART
FIGS. 12 to 15 are drawings illustrating the prior art.
Figure 13:
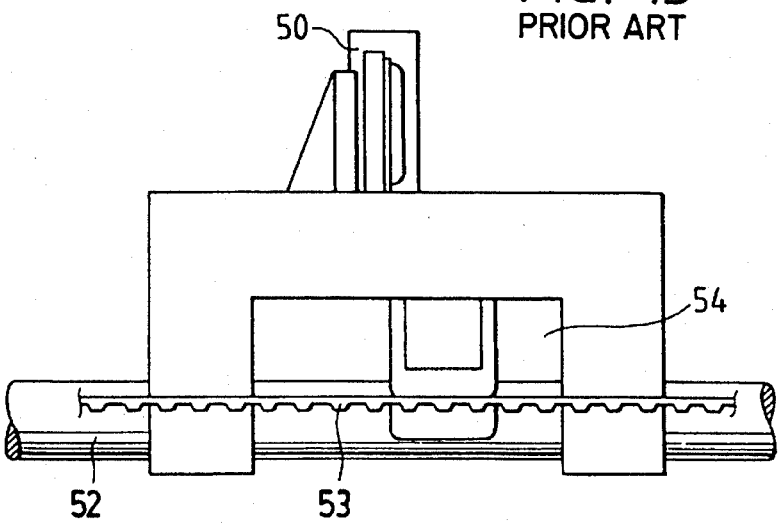
FIG. 13 PRIOR ART
Figure 14:
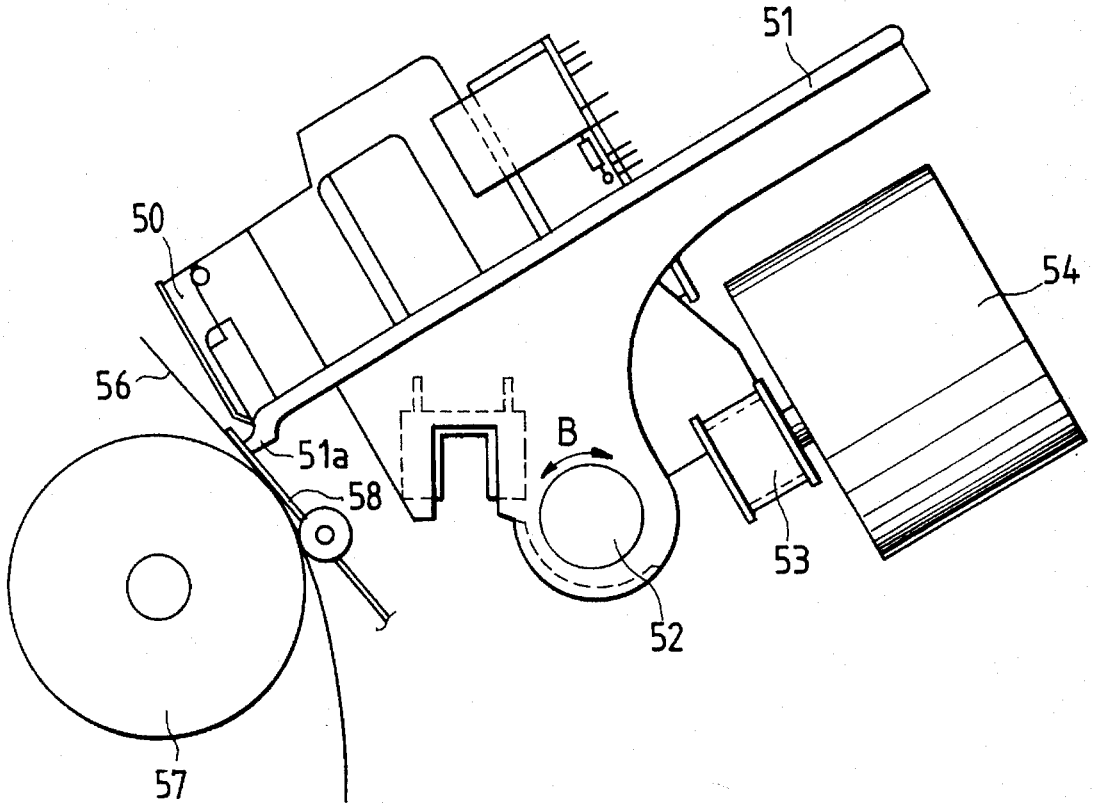
FIG. 14 PRIOR ART
Figure 15:
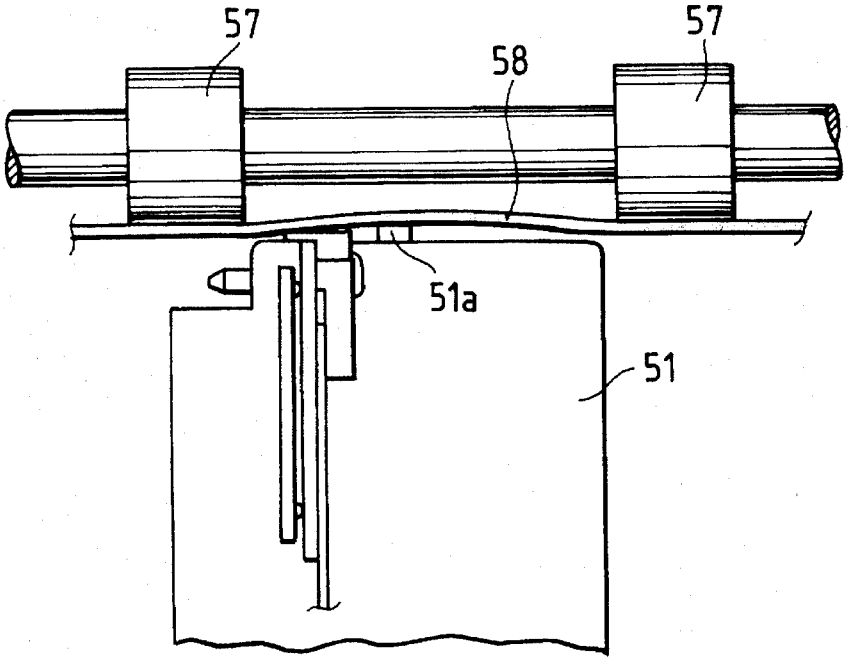
FIG. 15 PRIOR ART

As shown in FIG. 11, for example, it is conceivable to provide two individual contact portions $5a_1$ and $5a_2$ at both front ends of the carriage 5 with the cutout $5a_3$ (the length $l_4$) set in between contact portions. The pressure from these carriages $5a_1$ and $5a_2$ is not distributed even on the paper pressing plate. On the contrary, it is actually pinpointed at two spots: a left edge of the contact portion $5a_1$ and a right edge of the carriage contact $5a_2$ as shown in FIG. 11. Accordingly, the curvature of the paper pressing plate (where the contact portions $5a_1$ and $5a_2$ apply pressure) can be minimized as far as the total carriage length $(2l_3+l_4)$ is equal to the space interval $l_1$ which is set between the transport rollers 2a. This way, the carriage 5, which being pressed against the paper pressing plate 3, can travel without vibration.

Others

This invention can be broadly applied to recording apparatuses using a variety of recording methods (thermal printers, etc.). Especially in the case where this invention is applied to an ink jet recording method, remarkable results can be obtained for both the jet type recording head and the apparatus using this particular head (which performs recording by the ink emission by way of thermal energy). With this method, it is possible to achieve recording with high density and superb quality.

The present invention brings about excellent effects in recording heads and recording apparatus of the ink jet recording method that form flying liquid droplets by utilizing heat energy for recording, especially in ink jet recording methods.

As regards its typical configuration and principle, it is desirable to use the basic principle disclosed in, for example, U.S. Pat. Nos. 4,723,129 and 4,740,796 for operation. This method is applicable to both the so-called on-demand type and continuous type.

Especially in the case of the on-demand type, by applying at least one driving signal, that corresponds to the recording information and provides recording liquid with rapid temperature rise beyond nucleus boiling, to an electro-thermal converter, which is located corresponding to a sheet holding the recording liquid (ink) and the liquid path, generates heat energy in the electro-thermal converter, causing film boiling to the recording liquid on the heat operating surface of the recording head. As a result, it is possible to form air bubbles in the recording liquid by coping with this driving signal one to one.

At least one droplet is formed by allowing the recording liquid to discharge in air through the discharge port by means of an operation force, that occurs in growth and contraction process of this air bubble. Since providing this driving signal with pulse shape causes immediate and proper growth and contraction to air bubble, recording liquid especially excellent in response can be discharged, which is preferable.

For this pulse-shaped driving signal, such signals as specified in U.S. Pat. Nos. 4,463,359 and 4,345,262 are suitable. Also by adopting the conditions specified in U.S. Pat. No. 4,313,124 of an invention on rate of temperature rise on the above-mentioned heat operating surface, a further excellent recording can be performed.

For configuration of the recording head, in addition to a combination configuration (linear liquid flow path or rectangular liquid flow path) of such discharge port, liquid path and electro-thermal converter as disclosed in the above-mentioned each specification, configurations using U.S. Pat. Nos. 4,558,333 and 4,459,600 that disclose a configuration, in which the heat operating unit is located in a bending region, are also included in the present invention.

Further for the full-line type recording head having a length corresponding to the maximum width of a maximum recording medium which the recording apparatus is capable of recording, both a configuration, which meets the length by a combination of such plural recording heads, and a configuration as a single recording head integrated into one may be used.

In addition, when a replaceable chip type recording head, which an electrical connection with the apparatus body or supply of ink from the apparatus body is provided by mounting to the apparatus body, or a cartridge type recording head, in which the recording head itself is integrally provided with an ink tank, is used, the present invention is effective.

It is desirable to add recovery means for a recording head, preparatory auxiliary means, etc., which are provided as a configuration of a recording apparatus according to the present invention, because the effects of the present invention can be more stabilized. To concretely cite these, capping means for a recording head, cleaning means, pressurizing or suction means, electro-thermal converter, or another heating element or preheating means by a combination of these means, or predischarge mode, which discharges separately from recording.

Further, regarding kinds and number of the recording head mounted, one head may be used for monocolor ink and a plurality of heads may also be used, which have different colors and density. For example, the present invention is very useful for an apparatus which is equipped with not only a recording mode of main color such as black, but also a plurality different colors or at least one of full color by color mixture whether the recording head is integrally constructed or is composed of plural units.

Further, for a morphology of the recording apparatus equipped with a recording mechanism using a liquid jet recording head according to the present invention, morphologies of a copying machine combined with a reader, etc., and a facsimile apparatus having a transmitting and receiving function besides being used as an image output terminal of information processing equipment such as computers may be also taken.

Such ink may be softened or liquidized at a room temperature or controlled in temperature to stabilize ink viscosity by adjusting temperature within 30° C. to 70° C. in the ink jet method. Further, the ink is defined as the liquid that becomes solid under conditions at room temperature or below. Since the temperature of the ink is controllable in the range of 30° C. to 70° C. with the ink jet recording method, the ink viscosity is always kept at the optimum level at the ink discharge ports. Accordingly, any type of ink can be theoretically used as long as it can liquefy when impressed with a recording signal. As described in the Japanese Laid-Open Patent Application No. 54-56847 and No. 60-71260 official reports, such inks as explained above are contained in either concavities of a porous sheet, or perforations in the form of liquid or solid and positioned facing electrical-thermal converting elements.

As stated above, according to the present invention it is possible to provide a recording apparatus in which a constant gap is maintained between the recording medium and the recording means.

What is claimed is:

1. An apparatus having a carriage for moving along a sheet member and holding a head member, said apparatus comprising:

a guide member for guiding said carriage along and adjacent to the sheet member;

drive force transmitting means for transmitting a driving force to said carriage for moving said carriage along said guide member; and fixing means for fixing said carriage to said drive force transmitting means, said fixing means biasing said drive force transmitting means in a direction away from said carriage so that said carriage is biased in a direction toward the sheet member, wherein said fixing means includes a fixing member and a transmitting means sustaining member for securing said drive force transmitting means in said fixing member and said fixing member includes a plurality of depending legs for biasing said drive force transmitting means in the direction away from said carriage wherein said fixing member and said sustaining member are separate elements capable of being attached and detached.

2. An apparatus according to claim 1, wherein said head member comprises an ink jet head that discharges ink for recording.

3. An apparatus according to claim 1, wherein said head member comprises an ink jet head that discharges ink using thermal energy for recording.

4. An apparatus according to claim 1, wherein said drive force transmitting means includes a timing belt.

5. An apparatus according to claim 1, wherein said guide member is a rotational center for rotational movement of said head member as it moves towards and away from the sheet member.

6. An apparatus according to claim 1, wherein said transmitting means sustaining member includes a complementary, contoured face for receiving teeth of said drive force transmitting means.

7. An apparatus having a carriage for moving along a sheet member and holding a head member, said apparatus comprising:

a guide member for guiding said carriage along and adjacent to the sheet member;

drive force transmitting means for transmitting a driving force to said carriage for moving said carriage along said guide member; and fixing means for fixing said carriage to said drive force transmitting means, said fixing means biasing said drive force transmitting means in a direction away from said carriage so that said carriage is biased in a direction toward the sheet member, wherein said fixing means includes a fixing member and a transmitting means sustaining member for securing said drive force transmitting means in said fixing member and said fixing member includes a plurality of depending legs for biasing said drive force transmitting means in the direction away from said carriage, and wherein said drive force transmitting means comprises a timing belt having teeth, and said sustaining member includes a plurality of flexible fingers for snap-fitting said sustaining member to said fixing member and a belt receiving section having a contour face to receive the teeth on said timing belt.

8. An apparatus according to claim 7, wherein the head member comprises an ink jet member for ejecting ink.

9. An apparatus according to claim 7, wherein said guide member is a rotational center for rotational movement of the head member as it moves toward and away from the sheet member.

10. A securing mechanism for securing a carriage, for moving a recording member along a guide member provided along and adjacent to a sheet member, to a driving belt having teeth for driving said carriage, said securing mechanism comprising:

a securing member having a plurality of legs for bending said driving belt in such a direction that said driving belt is forced away from said carriage; and a belt supporting member for securing said securing member to said driving belt, wherein said driving belt is bent in the direction such that said recording member is biased to rotate about said guide member in another direction toward the sheet member, and wherein said belt supporting member includes a plurality of flexible fingers for snap-fitting said belt supporting member to said securing member and a belt receiving section having a contour face to receive the teeth on the driving belt.

11. A securing method for securing a carriage, for moving a recording member along a shaft member provided along and adjacent to a sheet member, to a driving belt having teeth for driving the carriage, said method comprising the steps of:

providing a securing member having a plurality of legs for bending the driving belt in such a direction that the driving belt is forced away from the carriage and a belt supporting member for securing the securing member to the driving belt, wherein the belt supporting member includes a plurality of flexible fingers for snap-fitting the belt supporting member to the securing member and a belt receiving section having a contour face to receive the teeth on the driving belt; and securing the carriage to the driving belt, by using the securing member and the belt supporting member, and by bending the driving belt in the direction such that the recording member is biased to rotate about the guide member in another direction toward the sheet member.

12. A mounting apparatus for mounting a carriage member, which supports a movable head member guided by a guide member provided along a sheet member, to a belt member for moving said carriage member, the belt member having a first engaging section, said apparatus comprising:

a belt receiving member for attachment to the carriage member and including a second engaging section to be engaged with the first engaging section of the belt member; and a fixing member for pressing said first and second engaging sections which engage with each other, said fixing member being attached to said belt receiving member in a direction transverse to a pressing direction of said first and second engaging sections, wherein said belt receiving member and said fixing member comprise means for elastically engaging with each other to prevent said fixing member from being removed from said belt receiving member, said fixing member and said belt receiving member being separate elements capable of being attached and detached.

13. An apparatus according to claim 12, wherein the second engaging section of said belt receiving member has a complementary, contoured face for receiving the first engaging section of the belt member.

14. An apparatus including a carriage for moving along a sheet member and holding a head member, said apparatus comprising:

a belt member for moving the carriage, said belt member having a first engaging section;

a belt receiving member affixed to the carriage and having a second engaging section engageable with said first engaging section; and a fixing member for pressing said first and second engaging sections when engaged with each other, said fixing member being attached to said belt receiving member in a direction transverse to a pressing direction of said first and second engaging sections, wherein said belt receiving member and said fixing member comprise means for elastically engaging with each other to prevent said fixing member from being removed from said belt receiving member, said fixing member and said belt receiving member being separate elements capable of being attached and detached.

15. An apparatus according to claim 14, wherein the second engaging section of said belt receiving member has a complementary, contoured face for receiving the first engaging section.

16. An apparatus according to claim 14, wherein the head member comprises an ink jet head member for ejecting ink.

17. An apparatus according to claim 14, further comprising a guide member for guiding the carriage, wherein said guide member is a rotational center for rotational movement of the head member toward and away from a sheet member on which the head member records.

18. An ink jet recording apparatus having a carriage for moving an ink jet recording head along a recording area defined in a recording medium conveying route opposable to an ink discharge port of the ink jet recording head, said apparatus comprising:

a guide member for guiding the carriage along the recording area, said guide member rotatably supporting the carriage in directions approaching and separating from the recording area;

drive force transmitting means for transmitting to the carriage a drive force for moving the carriage along the recording area;

a carriage positioning member provided along said guide member in the vicinity of the recording area between said guide member and the recording area;

a contacting portion provided at a leading end of the carriage on the side of the recording area, said contacting portion contacting said carriage positioning member when the carriage rotates in a direction approaching the recording area with said guide member as a rotational center;

a drive force transmitting member receiving portion provided on the carriage to fix the carriage and said drive force transmitting means, said drive force transmitting member receiving portion receiving the drive force for moving the carriage along the recording area from said drive force transmitting means and a biasing force for rotatably biasing the carriage in the direction approaching the recording area; and a fixing member for fixing said drive force transmitting means to said drive force transmitting member receiving portion, said fixing member comprising a biasing portion for causing the biasing force by biasing said drive force transmitting means in a direction away from said carriage and being detachably mounted on said drive force transmitting member receiving portion of said carriage.

19. An apparatus according to claim 18, wherein the carriage and said contacting portion are positioned so that said contacting portion rubs and contacts said carriage positioning member when the carriage moves along the recording medium located at the recording area by the drive force to record on the recording medium.

20. An apparatus according to claim 18, further comprising the ink jet recording head, wherein said ink jet recording head discharges ink for recording.

21. An apparatus according to claim 18, further comprising the ink jet recording head, wherein said ink jet recording head discharges ink using thermal energy for recording.

22. An apparatus according to claim 18, wherein said drive force transmitting member receiving portion includes a complementary, contoured face for receiving teeth on said drive force transmitting means.

* * * * *